US005947026A

United States Patent [19]

Murray et al.

[11] Patent Number: 5,947,026

[45] Date of Patent: Sep. 7, 1999

[54] APPARATUS FOR REDUCING DOWNSTREAM MARKING INCLUDING FOLDER MARKING

[75] Inventors: Robert Richard Murray, Madbury; John Sheridan Richards, Barrington, both of N.H.

[73] Assignees: Heidelberger Druckmaschinen AG, Heidelberg, Germany; Heidelberg Harris Inc., Dover, N.H.

[21] Appl. No.: 09/071,515

[22] Filed: May 1, 1998

[51] Int. Cl.[6] ..... B41F 1/28

[52] U.S. Cl. ..... 101/416.1; 101/424.1

[58] Field of Search ..... 101/416.1, 424.1, 101/487, 488

[56] References Cited

U.S. PATENT DOCUMENTS

| | | | |
|---|---|---|---|
| 5,189,960 | 3/1993 | Valentini et al. | 101/487 |
| 5,218,905 | 6/1993 | Bolte et al. | 101/169 |
| 5,526,742 | 6/1996 | Petersen | 101/487 |
| 5,546,861 | 8/1996 | Loffler | 101/487 |
| 5,571,564 | 11/1996 | Helms et al. | 101/487 |

FOREIGN PATENT DOCUMENTS

| | | | |
|---|---|---|---|
| 283722 | 9/1988 | European Pat. Off. | 101/424.1 |
| 0161152 | 8/1985 | Japan | 101/487 |
| 0191152 | 8/1987 | Japan | 101/487 |
| 232910 | 9/1944 | Switzerland | 101/424.1 |
| 1489593 | 10/1977 | United Kingdom | 101/416.1 |

*Primary Examiner*—Edgar Burr
*Assistant Examiner*—Anthony H. Nguyen
*Attorney, Agent, or Firm*—Kenyon & Kenyon

[57] ABSTRACT

An apparatus for preventing marking of a web which locally cools the web and thereby raises the viscosity of the ink imprinted thereon downstream of an initial cooling of the web. The cooling device may include liquid cooling of rolls in the press, air cooling of a contained environment of the press, or forcing a cooling gas onto a surface of the printed web.

2 Claims, 6 Drawing Sheets

APPARATUS FOR REDUCING DOWNSTREAM MARKING INCLUDING FOLDER MARKING

FIELD OF THE INVENTION

The present invention relates to rotary web-fed printing presses and more particularly, to an apparatus for reducing marking of the web of a printing press in the folder section of the printing press.

BACKGROUND INFORMATION

In web-fed printing presses, printing, drying, cooling, forming, folding, and curing operations are often done on a continuous operation machine, feeding in a web of blank paper from a roll and ending with a printed, cut, and folded product. It is often desirable to process the web as quickly as possible, which can contribute to a problem, conventionally referred to as "marking." Marking occurs, for example, when ink that has been printed on the web becomes smeared by downstream processing components such as the angle bars, former board, fan wheel, or other folder or former components. The ink smears when the printed web rubs against downstream components before the ink is sufficiently dry.

Numerous modifications have been attempted to try to solve the problem of ink smearing on press components downstream of the printing units. For example, one such attempt involves using higher viscosity inks so that the inks will not smear as readily as compared to lower viscosity inks. Another attempted solution is to use components with lower friction coefficients in order to prevent the friction force from smearing the ink and raising the temperature of the ink and web. Another attempted solution involves designing the press components and web path so that the normal forces between the web and the components are minimized in order to reduce the likelihood of smearing ink. Additionally, coating the web with silicone has been attempted to reduce friction and thereby reduce web marking. Another attempted solution to the smearing problem includes the use of an air flotation system wherein the web is floated on a cushion of air located between the component and the web, thereby preventing contact of the web and the component.

None of these attempted solutions, however, has adequately solved the problem of ink smearing on press components downstream of the print units. Further, printing presses may also include chill units placed after the dryer unit to lower the temperature of the web and to dry or set the ink. The chill units, however, have limited cooling effect and there is further processing of the web downstream of the chill unit, for example involving wrapping of the web around rollers or angle bars, and over former boards, that produces additional friction and additional heat in the web. In addition, the web is also exposed to room temperature air which contains moisture, which may be absorbed into the web as the web moves through air. Thus, cooling of the web by, for example, a chill unit after drying in an oven is not adequate to minimize the smearing of ink and web marking when a printed web contacts, for example, components of the former section, the angle bars, and other folder components of the printing press downstream of an initial cooling of the web.

SUMMARY OF THE INVENTION

It is an object of the present invention to provide an apparatus for reducing marking of a web that compensates for the additional heating of the web and resultant marking that can arise downstream of, for example, a chill unit.

The present invention therefore provides cooling of the ink on the web directly before or at a known marking point, so as to raise the viscosity of the ink and reduce marking at the marking point. This cooling may be in addition to an initial cooling of the web after printing in a standard chill unit. The cooling can thus be provided directly prior to web contact with the angle bars or other downstream folder components which cause marking. For example, the viscosity of certain inks with, for example, 85% of the solvent removed, may increase by approximately 7% for each degree Fahrenheit drop in temperature. A change in temperature of, for example, 15° Fahrenheit, from, for example, 90° F. to 75° F. or from 75° F. to 60° F. may result in a 100% increase in the viscosity of the ink. Thus, according to the present invention, creating a large heat sinking with a cooling temperature differential over a short period of time and just prior to contact with a marking element has a large effect on the viscosity of ink. Since marking decreases with increasing ink viscosity, marking is thus reduced.

By providing the cooling directly before or at a known marking point, the present invention thus avoids a problem encountered with using solely a chill unit, namely that the ink on the web may heat up again after leaving the chill unit and before coming into contact with marking points in a post-printing processing unit such as a folder.

DETAILED DESCRIPTION

Figure 1:
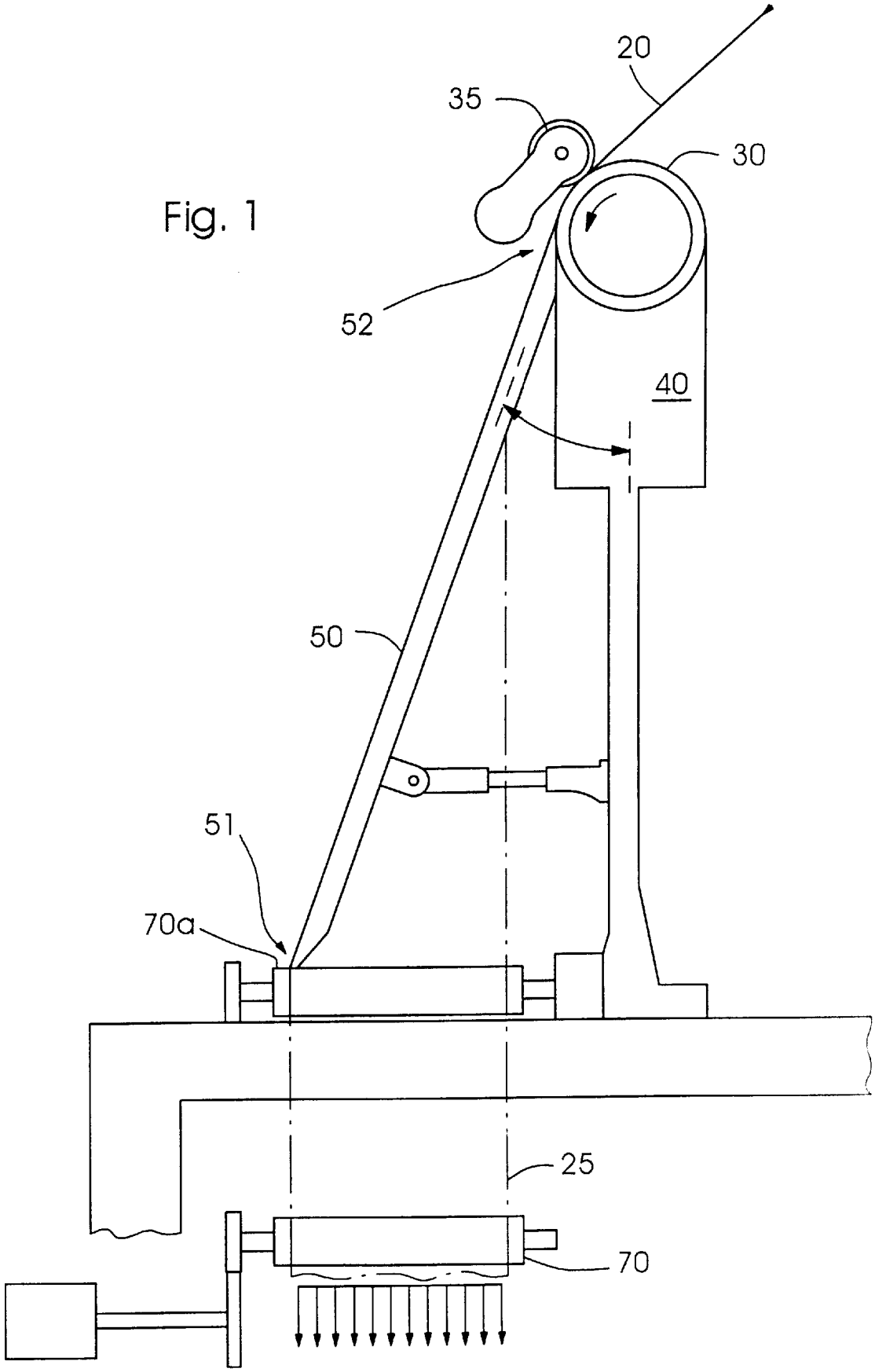
FIG. 1 is a side view of a former section and nip roll section of a printing press having a chilled roll.

FIG. 1 shows a former/folder section of a printing press as is generally known in the art. A web 20 travels from upstream components of a printing press (not shown), such as the infeed roll, printing units, dryer, or chill unit, to a roller 30 supported by a frame 40. The web 20 travels over the surface of the roller 30 with a velocity approximately equal to, for example, the speed of the web running through the press. After traversing a portion of the arc of the roller 30, the web 20 parts contact with the roller 30 and runs over a former board 50, located below the roller 30.

The former board 50 is, for example, triangular in shape with the top dimension (e.g., dimension along the roller 30) being approximately equal to the length of the roller 30, and thus sufficient to receive the full width of the web 20 on a top surface of the former board. The former board 50 is arranged, for example, so that its surface slants downward from the roller 30 forming an angle θ with the frame 40. A tip 51 of the triangular surface of the former board 50 points down and away from the roller 30, for example, at approximately the middle of the roller's width, as may be seen more clearly in FIG. 2.

The path of the web is radically altered by the forming rolls 70*a* which are directly under the forming board 50 and substantially level and parallel with one another and perpendicular to the roller 30. These rolls 70*a* are not driven and are adjustable to compensate for paper variations. These rolls 70*a* can cause marking due to the friction contact.

Figure 2:
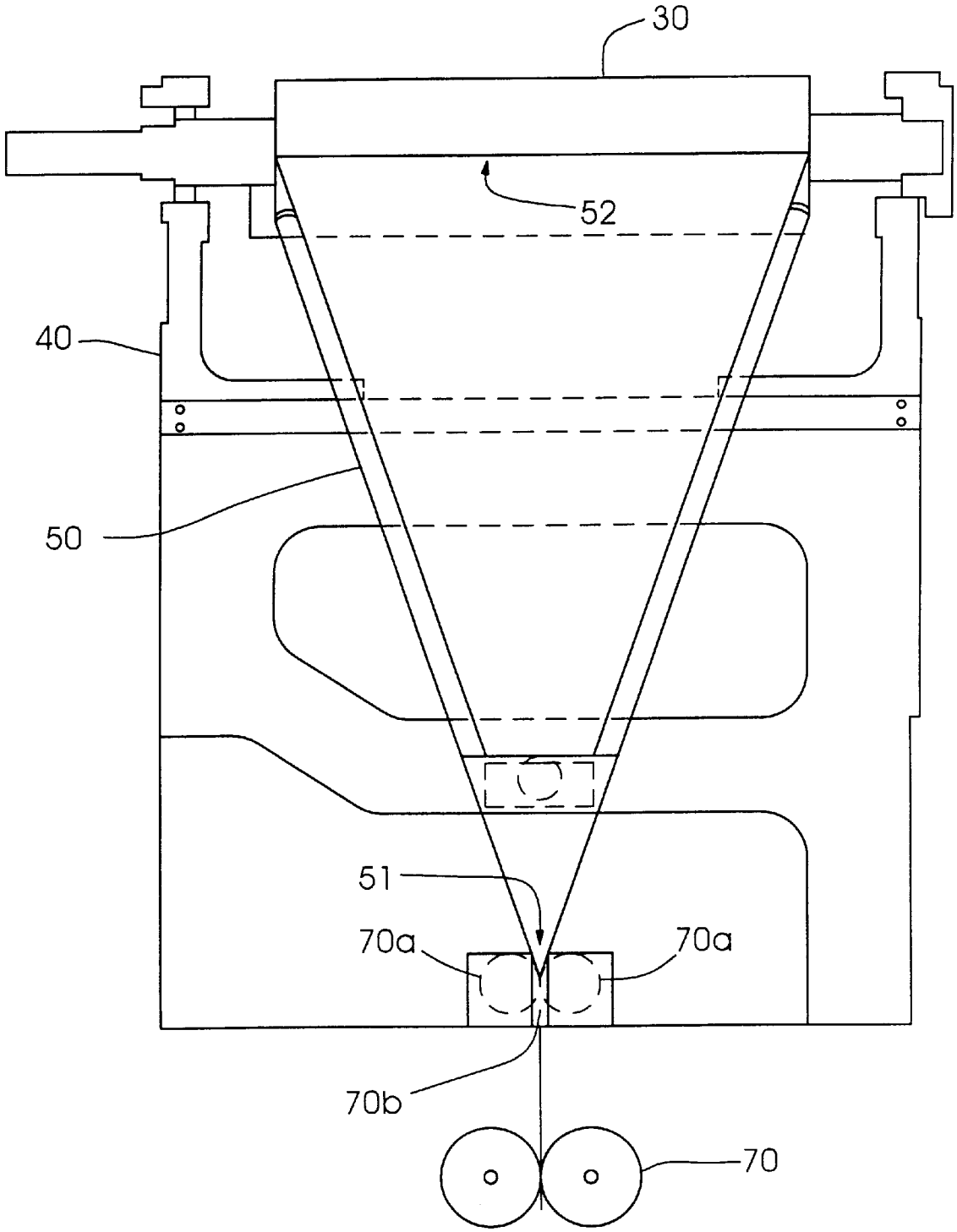
FIG. 2 is a front view of the apparatus of FIG. 1.

As shown in FIG. 2, the web 20 is pulled down over the former board 50 and through a nip 70*b* formed between the rolls 70*a* by, for example, a driven set of nip rolls 70. The nip rolls 70 are a pair of rollers positioned substantially parallel with one another with their axes roughly perpendicular to the axis of the roller 30. Via the set of nip rolls 70, the web 20 is folded in half longitudinally, facilitated by the triangular shape of the former board and the forming rolls 70*a*, such that when the web 20 enters the nip rolls 70 it is in a folded configuration substantially perpendicular to the plane in which the web 20 travels when it enters the former board 50.

As the web 20 is drawn over the former board 50, folded, and then drawn through the former rolls 70*a*, the web 20 can press down upon the former board 50 and thus may contact with the top surface as well as the edges of the former board 50. For example, the web 20 can particularly contact the former board 50 at the tip 51 as the web is pulled over the former board 50 and then through the forming rolls 70*a*. The contact and relative motion of the web 20 over the former board 50 can, for example, cause smearing of the ink and marking of the web 20, which may be compounded by the frictional heat generation which also raises the temperature and lowers the viscosity of the ink. (Additionally, the web 20 may contact, for example, angle bars, not shown here, and, if the ink on the web 20 is not sufficiently dry, the web may become marked as the ink surfaces on the web and the angle bars rub against each other.)

According to the present invention, roll 30 has an associated cooling unit to cool the roll so as to raise the viscosity of the ink as the web travels over the former board 50, which may be a known marking point.

FIG. 2 shows a front view of the former board 50 of FIG. 1. The generally triangular shape of the former board 50 can be seen, starting near the roll 30 with the top edge 52 of the former board 50 and drawing down to the tip 51 at the downstream end of the former board 50. The forming rolls 70*a*, into which the web is drawn after passing over the former board 50, are shown below the former board. The forming rolls 70*a* are substantially perpendicular to the roll 30 (also known as an RTF roll). The former board 50 forms a fold at approximately the middle of the web 20 as it passes over the tip 51 of the former board 50 and is drawn into the forming rolls 70*a* by the nip rolls 70.

Figure 3:
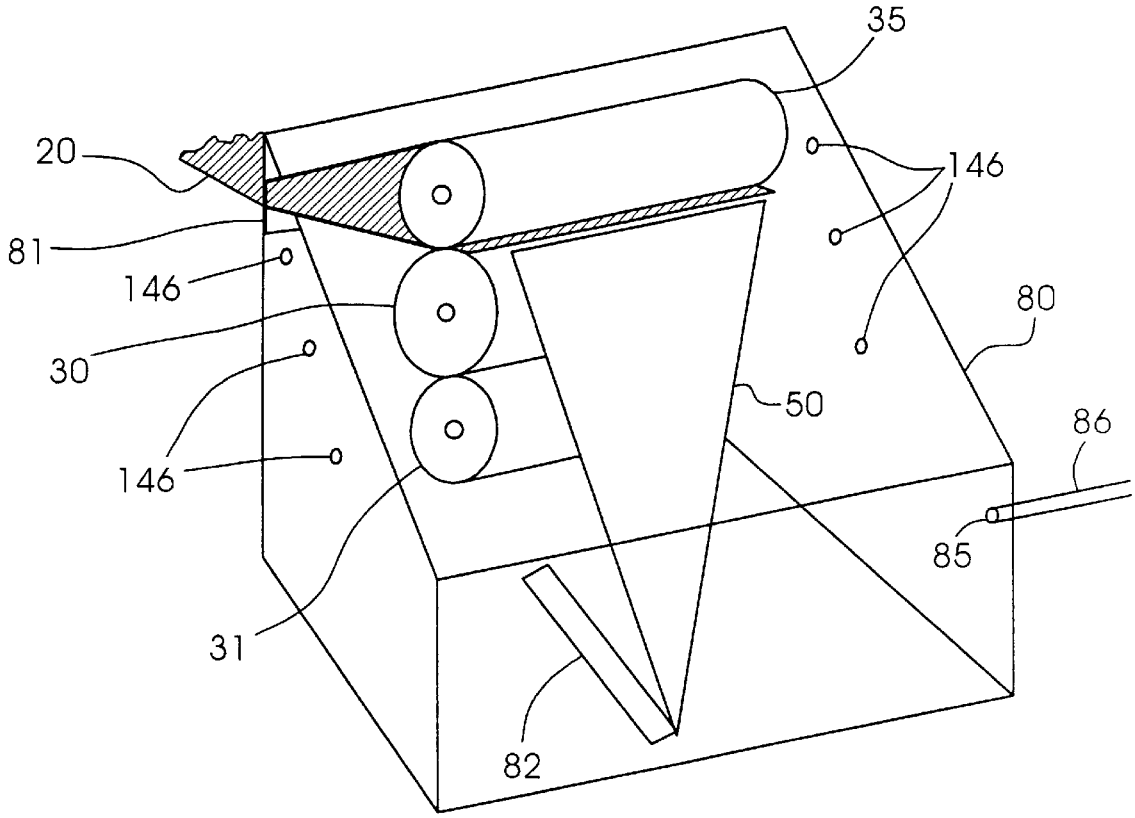
FIG. 3 shows a first exemplary embodiment of the present invention.

FIG. 3 shows a more clearly an embodiment of the present invention for reducing the smearing of ink and marking of the web by increasing the viscosity of the ink on the printed web during processing of the web 20. (For clarity the web 20 is not shown over former board 50.) According to this embodiment, existing rolls in the former section of the printing press are cooled by a controlled flow of cooling fluid. For example, the RTF roll 30 at the top of the former and a cooling roll 31 are cooled with a liquid or gas that is circulated to the RTF roll 30 and the cooling roll 31 from a source of cooling fluid (not shown). The cooling fluid can include, for example, water, $NH_3$, $CO_2$, $N_2$ or compressed air pumped through the rolls 30, 31 via a refrigeration and/or pumping system. A nip roll 35 can also be cooled.

Figure 3A:
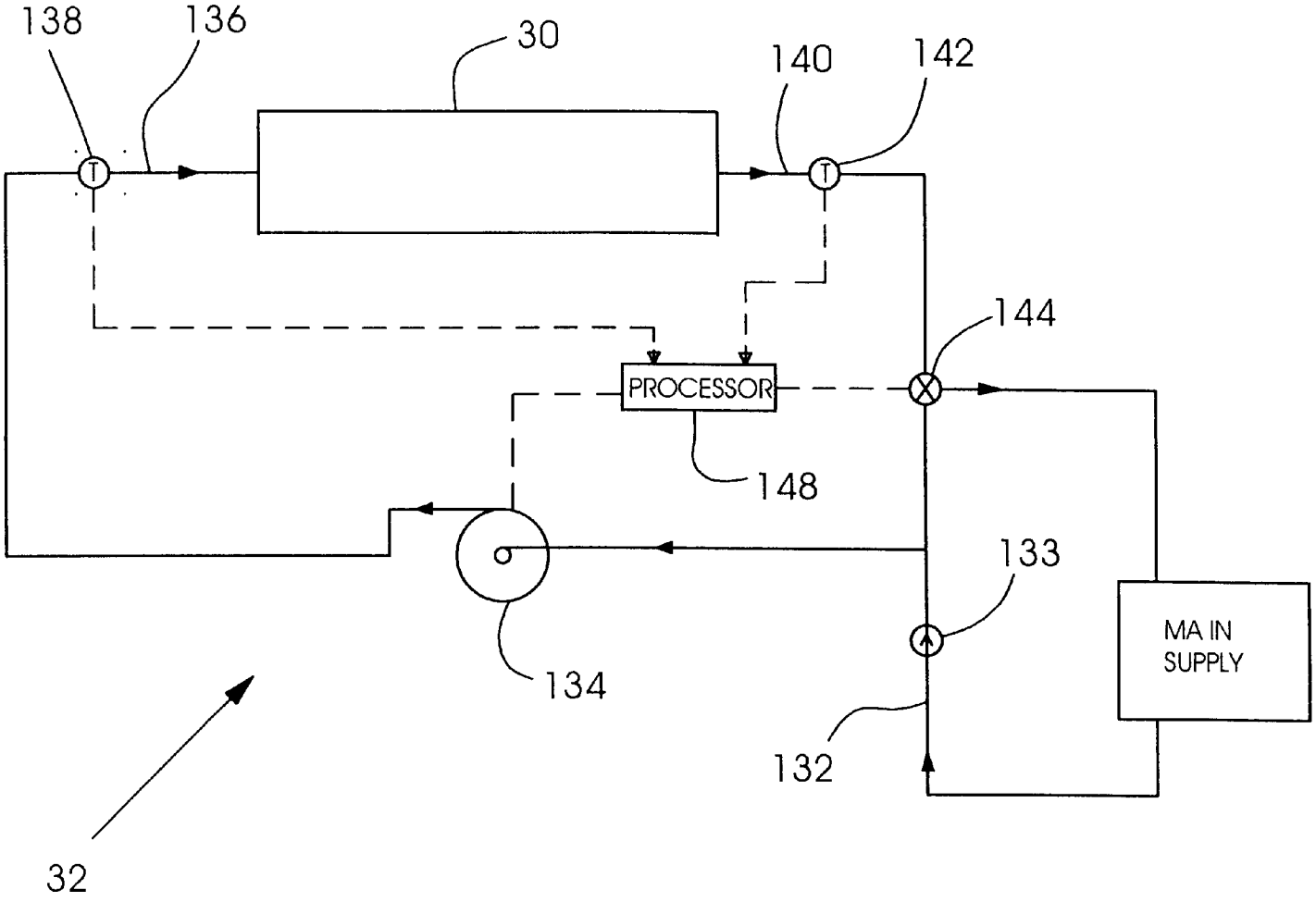
FIG. 3A shows a control system for the cooled rolls of the first embodiment.

As shown in FIG. 3A, the flow of fluid may be controlled by a flow control system 32 that, for example, regulates the amount of fluid circulated based on the change in temperature of the fluid delivered to the rolls 30, 31 and the temperature of the fluid returned from the rolls 30, 31. As an example, the flow control system 32 might provide cooling fluid at a certain flow rate to the RTF roll 30 at °F. to create a drop in the paper temperature, which is for example at 90° F. The fluid that exits the RTF roll 30 then might rise to a temperature of, for example, 53° F.

FIG. 3A shows the fluid control system 32 for the roll 30 when the fluid is water. Water at, for example 50.0° F., flows through line 132 though a anti-back flow valve 133 from a main supply at that temperature, and passes through a variable flow rate pump 134 and then to an inlet 136. The temperature at the inlet 136 is measured by a temperature sensor 138. The water passes through the roll 30 and exits at the outlet 140, where the temperature is again measured by an outlet temperature sensor 142. If the temperature difference of the water between the outlet 140 and the inlet 136 exceeds a certain difference, for example 3.0° F., a temperature controlled valve 144 opens and the heated water is returned to the main supply which is cooled to maintain at a constant temperature. More water from the main supply line at 50° F. is then provided through line 132 and the anti-back flow valve 133. If the temperature difference between the inlet and outlet is less than 3.0° F., the temperature controlled valve can remain shut or only partially open so that at least a part of the outlet water recirculates back through the pump 134.

If the temperature difference exceeds a further certain amount, for example, 3.1° F., the flow rate of the pump 134 may be increased so that more cooling is provided. (It should be noted that at this point the temperature controlled valve 144 is fully open so that the inlet water is coming from the main supply). When the temperature difference drops back to 3.0° F. or lower, the flow rate of the pump can be stabilized or reduced. In this manner, a desired temperature difference between the inlet and outlet water temperatures can be set. It should also be appreciated that the flow rate of the pump could also be controlled as a function of the web speed or ink temperature in addition to the water temperature difference. A microprocessor 148 can control both the pump and the temperature control valve.

It is also possible that the pump 134 be run at a constant or full speed instead of at variable speed when the temperature difference is greater than desired. This reduces the complexity of the present system and allows for the use of a single-speed pump. It is also possible that the valve 144 and related flow system may be located between pump 134 and temperature sensor 138.

The RTF roll 30 and cooling roll 31 may be constructed for example in the manner of U.S. Pat. No. 4,805,690, which is hereby incorporated by reference herein. For $NH_3$, $CO_2$, $N_2$ or like cooling systems, a simple refrigeration cycle with a heat exchange condensing unit can be used to control the temperature in the roll 30. The rolls 31, 35 can be cooled in a like manner to roll 30.

FIG. 3 also shows cooling the ink directly at the marking points by enclosing the web at the marking points. Thus, in addition or alternatively to cooling selected rolls reduce the temperature of ink on the printed web 20, the former section of the printing press also may be enclosed in a chamber or cover 80 in which the environmental conditions, including temperature, pressure, and humidity, may be controlled. The chamber 80 provides a substantially closed system around the web 20 and former board 50. The controlled environment chamber 80 preferably is used in conjunction with the fluid flow cooling system 32 described above, and holes 146 in the chamber 80 may be provided for inlet and outlet lines to the various cooled rolls. A reduction in humidity thus advantageously can reduce the formation of condensation of atmospheric water on the cold surface of the rolls 30, 31, 35.

As shown in FIG. 3, the chamber 80 has an opening slot 81 to allow the web 20 to enter into the chamber 80 and an exit slot 82 for the folded web 20 to exit the chamber 80 after passing over the former board 50. The chamber 80 also has a supply port 85 to which a supply line 86 can be attached. The supply line 86 supplies, for example, dry air with 20% relative humidity and a dew point temperature of 40° F. The supply line 86 provides a continuous supply of cooled air which flows into the chamber 80 and will also continuously flow through of the chamber 80 via the opening slot 81 and exit slot 82. An extension can be added to the slots to minimize outward air flow.

Figure 4:
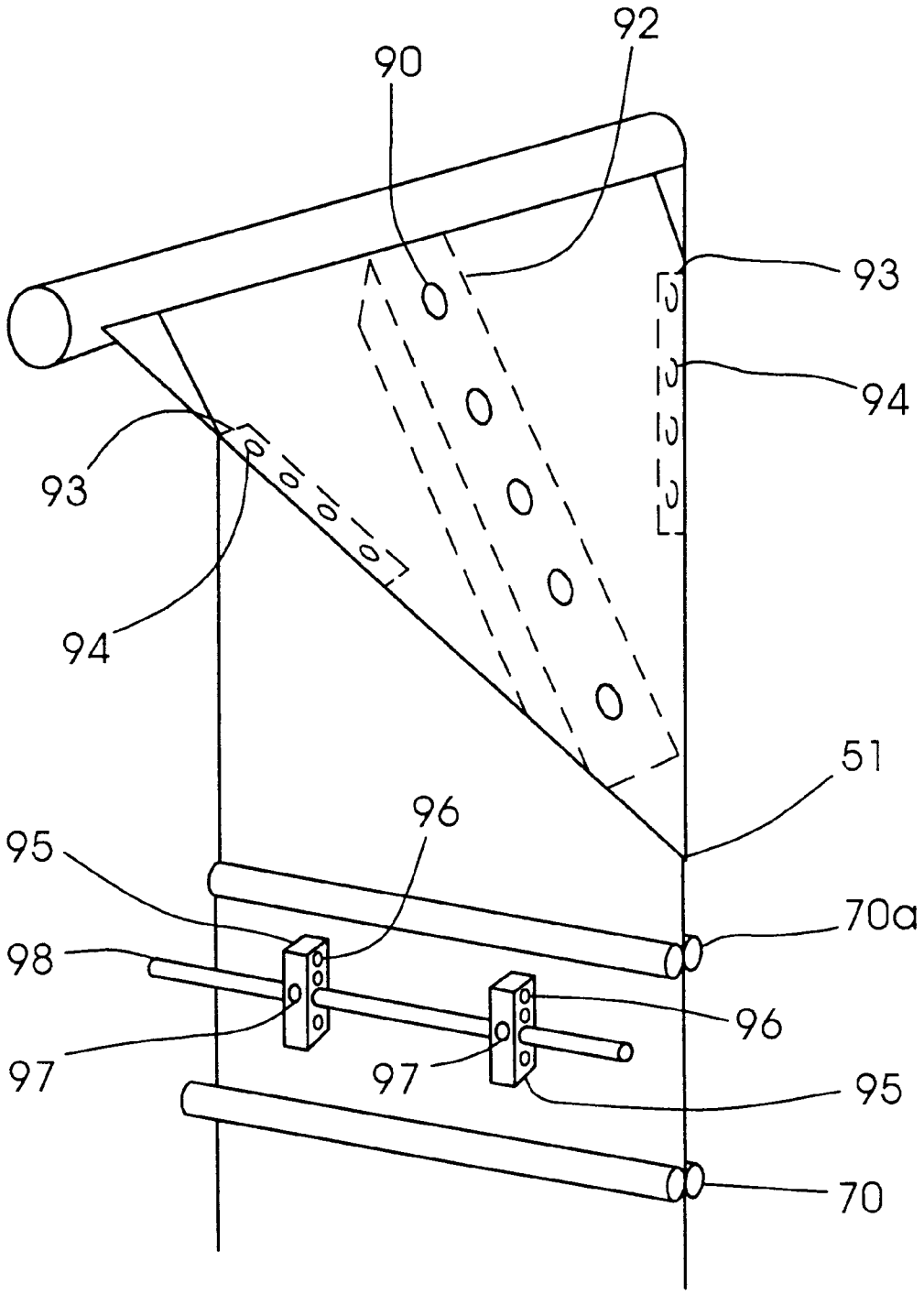
FIG. 4 shows a second exemplary embodiment of the present invention.

The exemplary embodiment of FIG. 4 shows a modified former board 50 according to the present invention in which holes 90 have been placed down a center section 91 of the former board 50. The holes 90 pass from the bottom surface (away from the web side) to the upper surface (web-facing side) of the former board 50. A manifold 92 adjacent to the bottom surface of the former board 50 is in fluid communication with the holes 90. The manifold 92 is supplied with a gas, such as air, $N_2$, or $CO_2$ having a specified temperature and pressure, such as 30° F. and 0.2 Torr. The gas may thus enter the manifold, flow through the holes or jets 90 and into contact with the web 20 traveling over the former board 50. The flow of gas cools the web 20 and consequently the ink contained thereon. By cooling the ink, the viscosity of the ink is raised and thus marking of the web is reduced or described above, e.g., a 7% change in viscosity of the ink for each degree Fahrenheit change in temperature. In addition to its cooling properties, the gas also provides a gas cushion upon which the web 20 may traverse which helps alleviate direct contact between the web 20 and the former board 50 to further reduce marking.

In an alternative embodiment (not shown) of a former board 50, wherein the former board 50 is constructed as framework in which the top edge 52 and side edges (See FIG. 1) are frame members such that there is not a top surface of the former board 50, the holes 90 may be constructed in a manifold member that is attached to the frame of the press or the top edge 52 of the former board 50. The holes of the manifold member advantageously emit a cooling gas to the central section of the web 20 as it approaches the tip 51 of the former board 50.

In addition to the center manifold 92, the former board 50 may be modified to include side manifolds 93 along the outside edges of the former board 50. The side manifolds 93 may have holes 94 which may open on the top surface of the former board 50 and/or open on the edges of the former board 50 as shown in FIG. 4. Cooled gas may b supplied to the side manifolds 93, the cooled gas passing through the holes 94 and into contact with web 20 to aid in cooling the ink on web 20.

A further option for supplying cooling gas includes the adaptation of one or more manifolds or gas tubes 95 below the former board 50 after the forming rolls 70*a*, as shown in FIG. 4. Gas tubes 95, shown adjacent to and on one side of the folded web downstream of the former board 50 and its nose 51, are provided with outlets 96 disposed on the web outside surface of the gas tubes 95, through which cooling gas may be directed onto the web 20 as it passes toward the next marking point. Though the gas tubes 95 are shown in an approximately vertical orientation, one of skill in the art will recognize that the gas tubes 95 may be rotated at an angle about a support 97. The supports are also movable on a mounting rod 98, so that the gas jets 95 can be positioned to cool the ink as needed. It should be understood that more than two gas tubes 95 can be provided and that each side of the folded web may have a set of gas tubes, and that the cooling gas can be provided through the rod 98 to the gas jets 96.

The length of the manifold and the volume, temperature and type of gas flow will help control how much cooling is delivered to the ink and how low the temperature will be. The placement of the manifold or gas tubes will determine where the low temperature and resulting high viscosity ink strip will be located on the web. Using the adjustable supports 97 on the rod 98, the desired cooling location can be aligned with problem marking points caused by the nip rolls 70.

Additionally, the gas tubes may be provided substantially parallel to the surface of the former board 50 to provide cooling gas to the former board 50 substantially along its length from the RTF roll 30 to the tip 51.

Figure 5:
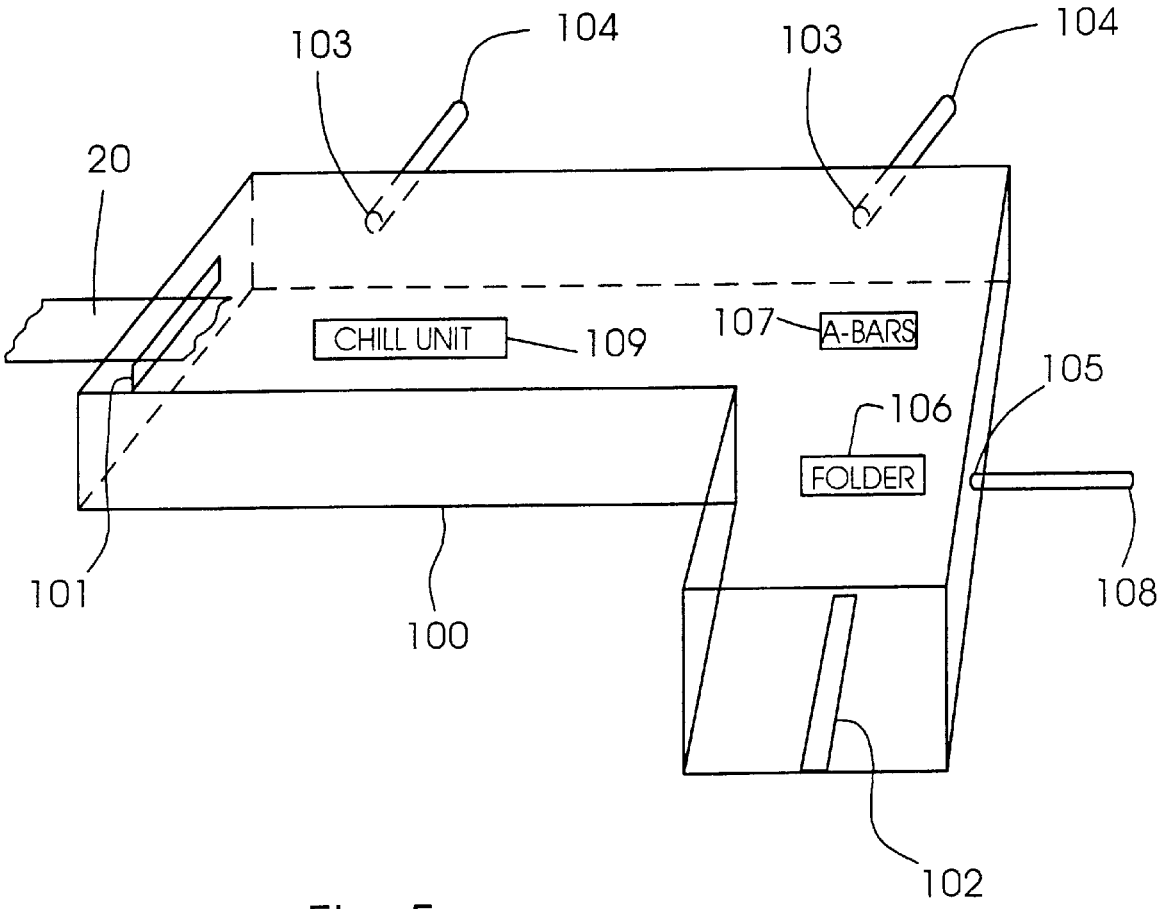
FIG. 5 shows a third exemplary embodiment of the present invention.

FIG. 5 shows a third exemplary embodiment of the present invention wherein a number of entire post-printing processing units are enclosed in a controlled cooled environment so that heat is removed from the web 20 in order to raise the viscosity of ink imprinted on the web 20. The cooling gas, for example cooled air, is injected into a large cooing chamber 100 at a specified input temperature and humidity, for example 55° F. and 40% relative humidity to create a favorable environment for removing heat and moisture from the web 20.

The cooling chamber 100 creates an enclosed environment about the web 20 and the components of the printing press with which the web 20 comes into contact. The cooling chamber 100 may enclose, for example, the chill unit 105, former section, angle bars 107, and folder 106 of a printing press. The web 20 enters the chamber 100 through a web entry 101 aligned such that the web 20 can traverse from the preceding processing unit, such as the dryer (not shown) to the first processing unit contained within the chamber 100, such as the chill unit (not shown). Similarly, the chamber 100 will have a web exit 102 to allow the web to traverse from the last processing unit contained within the chamber 100, such as the folder to a processing unit outside of the chamber 100, without interference with the travel of the web.

The chamber 100 has, for example, at least one, and perhaps several inlets 103 through which the cooling gas flows into the chamber 100. Gas pipes 104 transport cooling gas to the inlets 103 from, for example, a conventional chiller system or heating, ventilation and air conditioning system (not shown) which provides gas at an appropriate temperature, humidity, and pressure for example, 55° F., 40% relative humidity, and pressure of the atmosphere+one (1) inch $H_2O$ (1"$H_2O$=0.036 pounds per square inch). The gas is removed from the chamber 100 through exhaust ports 105. The gas may be released to the room or recalculated to the chiller system as desired. Enough gas may be provided to set the outlet temperature, for example, at approximately 58° F. The exhaust ports 105 may connect to exhaust pipes 106 via standard pipe connections as are known in the art.

By maintaining the closed environment of the chamber 100 at a reduced temperature and humidity, the viscosity of the ink on the web 20 is increased which in turn reduces the marking and smearing of ink on the web 20. The reduced temperatures help remove heat that may be generated by friction from the contact of the moving web over the press components, as well as latest heat present in the web and in the ink that could not be fully removed in, for example, the upstream chill unit.

As will be recognized by those skilled in the art, the present invention is not limited to the preferred embodiment here presented. For example, alternative configurations can be conceived, such as combinations of the above discussed embodiments, that reduce the temperature of press components and of the environment surrounding the components downstream of an initial cooling of the web to thus cool the web and the ink on it to further raise the viscosity of the ink and thereby reduce marking of the web. The marking elements may include angle bars, folder fan tips, guide rollers, and those as would be recognized by one of skill in the art.

What is claimed is:

1. A device including a manifold and in a rotary printing press for reducing marking on a web having at least a first side imprinted with ink, the web passing over at least one area where marking occurs in a post-printing processing unit, the device comprising:

at least one cooling device for raising the viscosity of the ink, the cooling device including a manifold and being located directly before the at least one are where marking occurs;

wherein the post-printing processing unit includes a former having forming rolls and nip rolls, and wherein the manifold of the cooling device is located between the forming rolls and the nip rolls of the former.

2. A device in a rotary printing press for reducing marking on a web having at least a first side imprinted with ink, the web passing over at least one area where marking occurs in a post-printing processing unit, the post-printing processing unit including a former having forming rolls and nip rolls the device comprising:

at least one cooling device for raising the viscosity of the ink, the cooling device including a manifold and being located directly before the at least one area where marking occurs, the manifold of the cooling device being located between the forming rolls and the nip rolls of the former; and a rod and at least one additional manifold, the manifold and the additional manifold being movably supported on the rod.

* * * * *